US009614322B1

(12) United States Patent
Gibboney, Jr.

(10) Patent No.: US 9,614,322 B1
(45) Date of Patent: Apr. 4, 2017

(54) MAGNETIC REPULSION-BASED ELECTRICAL CONNECTOR

(71) Applicant: Christmas Northeast, Inc., Trumbull, CT (US)

(72) Inventor: James W. Gibboney, Jr., Conyers, GA (US)

(73) Assignee: Christmas Northeast, Inc., Trumbull, CT (US)

( * ) Notice: Subject to any disclaimer, the term of this patent is extended or adjusted under 35 U.S.C. 154(b) by 0 days.

(21) Appl. No.: 15/063,948

(22) Filed: Mar. 8, 2016

(51) Int. Cl.
*H01R 13/62* (2006.01)
*H01R 13/64* (2006.01)
*H01R 13/24* (2006.01)
*H01R 11/30* (2006.01)

(52) U.S. Cl.
CPC ..... *H01R 13/6205* (2013.01); *H01R 13/2421* (2013.01); *H01R 13/64* (2013.01); *H01R 11/30* (2013.01)

(58) Field of Classification Search
CPC . H01R 13/2421; H01R 13/6205; H01R 11/30
USPC ..... 439/38, 39, 40, 41, 305; 362/123
See application file for complete search history.

(56) References Cited

U.S. PATENT DOCUMENTS 2,573,920 A 11/1951 McLeod
3,706,882 A * 12/1972 Eby ..... B60Q 1/18 362/398
6,575,764 B1 6/2003 Reipur
8,272,876 B2 9/2012 Schultz
8,734,165 B2 * 5/2014 Neel ..... H01R 11/30 439/39
8,936,472 B1 1/2015 Gibboney, Jr.
2010/0181841 A1 7/2010 Azancot et al.
2011/0159706 A1 6/2011 Wu
2012/0295451 A1 11/2012 Hyun-Jun et al.
2014/0099808 A1 * 4/2014 McClelland ..... H01R 13/6205 439/153
2014/0256163 A1 * 9/2014 Kuo ..... H01R 13/6205 439/39

* cited by examiner

*Primary Examiner* — Hae Moon Hyeon
*Assistant Examiner* — Justin Kratt
(74) *Attorney, Agent, or Firm* — Nexsen Pruet, LLC; Michael A. Mann, Esquire

(57) ABSTRACT

Electrical connectors use magnetic repulsion for orienting themselves in the right polarity and magnetic attraction for holding together. When inserted into the ends of a conduit, a pair of these electrical connectors can transfer electricity through the conduit. Each electrical connector includes a housing with top and bottom surfaces and a fixed and a movable terminal both of which are recessed below the top surface of their respective, parallel passages. A spring controls terminal movement. Each terminal carries an electrical contact. A torus-shaped magnet surrounds the contact of the contact in the movable terminal so that its magnetic field energizes that contact. The magnets in movable terminals of each electrical connector are oriented in the same way so movable terminals of electrical connectors repel each other but fixed terminals attract movable terminals from their passages and into the passages of the fixed terminals so that two electrical connectors lock together.

19 Claims, 8 Drawing Sheets

MAGNETIC REPULSION-BASED ELECTRICAL CONNECTOR

TECHNOLOGICAL FIELD

The disclosure relates to electrical connectors for passing electrical current. More particularly, the present disclosure relates to electrical connectors that connect magnetically.

BACKGROUND OF THE INVENTION

Most electrical connectors are joined by mechanical means, typically using a male/female, frictionally-fitting connection, so that they can pass an electrical current from one connector to the next. Mechanical connectors require manual effort to join. Connectors that use magnetism rather than a mechanical connection are known. The magnetic force may be used to join the two connectors rather than manual effort. U.S. Pat. No. 8,936,472, which is incorporated herein in its entirety by reference and which is owned by the present applicant, discloses such a connector. Magnetic connectors are useful in circumstances where the two connectors cannot be easily joined by manual effort.

One example of circumstances in which access to couple two connectors is limited is in artificial holiday trees. Electrical current is passed by conductors via tubes or poles that simulate the trunk of an evergreen tree. Existing pole construction for artificial holiday trees uses an indentation and protrusion interlock system to serve as a key and keyway arrangement for correctly orienting the connectors. This method is old and, because the connecting poles tend to come apart when the tree is lifted or get stuck together, results in tree assembly, disassembly, and safety issues.

A set of connectors that is reliable and that is readily connect in the proper polarity without having to be physically oriented and physically joined, yet is inexpensive to manufacture in quantity, durable, effective, and safer, would be advantageous.

SUMMARY

The present electrical connectors use magnetic repulsion for orienting one connector properly with respect to another, and use magnetic attraction for holding two connectors together in the right polarity. Each electrical connector is identical so there are fewer parts required for manufacturing and assembly of the electrical connectors is greatly simplified. The present electrical connectors may be used to improve electrical connection in applications where electrical connectors may be difficult to join because of limited physical access or because of low light conditions.

When inserted into the ends of a conduit, a pair of the electrical conduits can be used to add electricity transfer to the structural conduit, which may have numerous uses as temporary barriers that carry electricity for temporary lighting.

An aspect of the disclosure is an electrical connector having a housing with a top surface and a bottom surface, a first passage and a second passage, and a fixed and a movable terminal in the first and second passages respectively. The first and second passages are spaced apart, open to both the top and bottom surfaces of the housing and run in parallel. There is a first contact on the fixed terminal and a second contact on the movable terminal. There is a magnet in the second passage proximate to the second contact, and its magnetic field runs through the second contact.

Another aspect of the disclosure is that the movement of the movable terminal is limited so that the second contact rises above the top surface of the housing by a predetermined distance.

Another aspect of the disclosure is that the electrical connector has a ferromagnet in the first passage proximate to the first contact of the fixed terminal. A ferromagnet is a device made of ferromagnetic material, that is, material attracted to a magnet but which material is not magnetic.

Still another aspect of the disclosure is that the first and second contacts have complementary surfaces on their expanded portions that interleave when the complementary surfaces are brought together.

An aspect of the disclosure is that the ferromagnet and magnet are torus-shaped and surround but do not touch the first and second, respectively.

Another aspect of the disclosure is that the first and second contacts both comprise an expanded portion, an upper shaft connected to the expanded portion, and a lower shaft. The lower shafts each have hole that receives the upper shaft.

Still another aspect of the disclosure is that the electrical connector has a compression spring in the second passage, which spring is connected to the second contact. The compression spring resists movement of the magnet, which surrounds the contact, toward ferromagnetic material that might be brought near the top surface of the housing.

Yet another aspect of the disclosure is that the fixed terminal is held in place by a spring washer. The spring washer is attached to the lower shaft of the first terminal.

An aspect of the disclosure is that both the first passage and the second passage have a wall therein dividing these passages into upper chambers and lower chamber. Each of the walls has a hole formed therein dimensioned to receive the lower shafts of the first and second contacts, respectively, passing from the upper chambers into the lower chambers. A spring washer in the lower chamber of the first passage is attached to the lower shaft and engages the wall of the first passage to hold the fixed terminal against movement of the first contact with respect to said housing. In the second passage, the lower shaft extends through the wall of the second passage and through a compression spring and a spring washer. The compression spring and the spring washer cooperate with the wall to limit movement of the second contact of the movable terminal above the top surface when the magnet surrounding the second contact is attracted to a ferromagnetic material.

Another feature of the disclosure is that two electrical connectors, can be joined by a pair of wires, one wire running from the first contact of the first of two electrical connectors to the first contact of the second electrical connector and the other wire running from the second contact of the first of the two electrical connectors to the second contact of the second electrical connector.

Another aspect of the disclosure is that the two electrical connectors can be carried near the ends of a conduit with one electrical connector flush-mounted with the first end of the conduit and the other recessed in the second end of the conduit.

Other features and their advantages will be evident to those skilled in the art of electrical distribution from a careful reading of the following detailed description, accompanied by the following drawings.

BRIEF DESCRIPTION OF THE DRAWINGS

In the figures.

DETAILED DESCRIPTION

The present disclosure describes a universal electrical connector. It also describes a pair of such connectors in electrical connection with each other to serve as an extension cord. That extension cord can be carried in a conduit to enable electrical power to be delivered in a structural member for use in temporary barriers with lighting, for example.

The term universal connector means that the connector is neither a "male" connector nor a "female" connector; the same configuration for the present electrical connector is used for both "plug" and "socket," although the housing shapes may be varied depending on the context of use. Two such connectors can be joined together to pass electricity from one connector to another or the present connector can be used on both ends of an extension cord. Therefore, for example, in an extension cord with an electrical connector according to the present disclosure on each end, either end of the extension cord can be connected to a wall outlet, provided that the wall outlet mates with the present connector. The remaining end of the extension cord can be connected to, for example, an appliance having the same type of electrical connector.

An extension cord as disclosed herein can be inside a conduit with one of the electrical connectors flush-mounted to one end of the conduit and the other electrical connector recessed in the opposing end of the conduit so that a portion of the conduit extends past the connector. That end of the conduit can receive the end of a second such conduit that has an electrical connector flush mounted so the two mating connectors are inside the conduit. Each such conduit added to the previous conduits not only increases the total length of conduit but connects extension cords using the present electrical connectors together in a continuously conductive chain so that not only is the conduit available for a structural purpose (a barrier, a railing or trim piece) but so, too, is the electricity carried by a series of extension cords inside.

The term conduit is used herein to refer to any structural member that has a passage formed in it that generally follows the major dimension of the conduit.

In the present disclosure, electrical connectors are said to connect when they are in a position relative to each other with their contacts touching so as to be able to transfer electricity from one contact of one electrical connector to the other.

Figure 1:
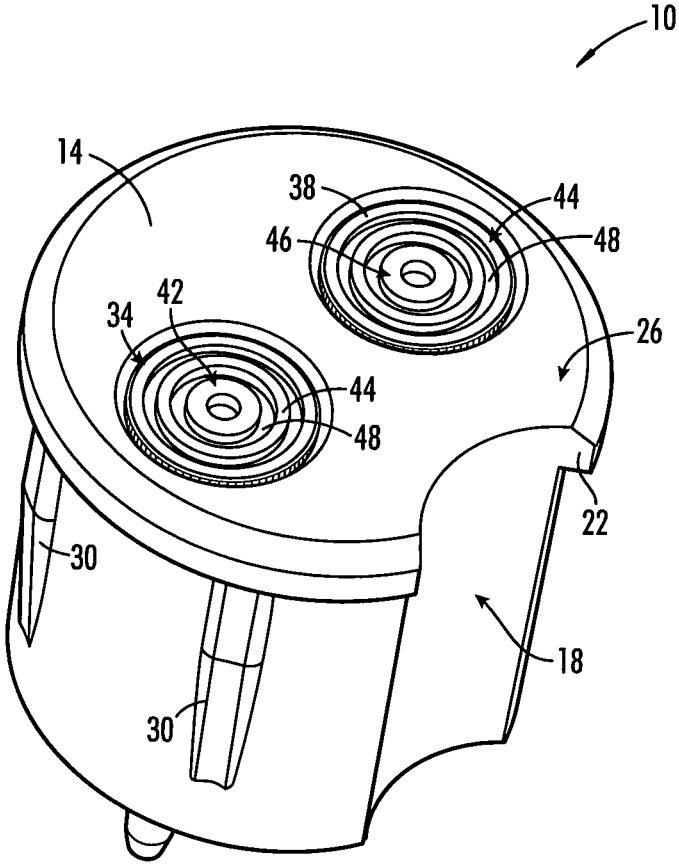
FIG. 1 is a perspective, top view of a connector according to an aspect of the disclosure.

Referring now to FIG. 1, there is illustrated in perspective an electrical connector 10. Electrical connector 10 has a housing 14 which may be primarily cylindrical or have a different shape, and it may have an axial groove 18, as shown in FIG. 1, for certain applications. For example, axial groove 18 in connector 10 may allow it to slide into a conduit (not shown in FIG. 1) that has an internal axial ridge. Axial groove 18 corresponds to such an internal axial ridge, which may be used to align adjacent sections of conduit with each other. Electrical connector 10 would need to have a housing shape that conforms to the interior shape of the conduit in that example but does not otherwise require axial groove 18 for its primary purpose, which is to connect to a second electrical connector 10.

Housing 14 may have other features that adapt it to its environment, such as a flange 22 on its top surface 26 and plural ribs 30 that allow it to be inserted flush with the end of a conduit (not shown) and fit there tightly.

Electrical connector 10 has two terminals, a fixed terminal 34 and a movable terminal 38. Fixed terminal 34 includes a contact 42; movable terminal 38 has a contact 46.

Figure 2:
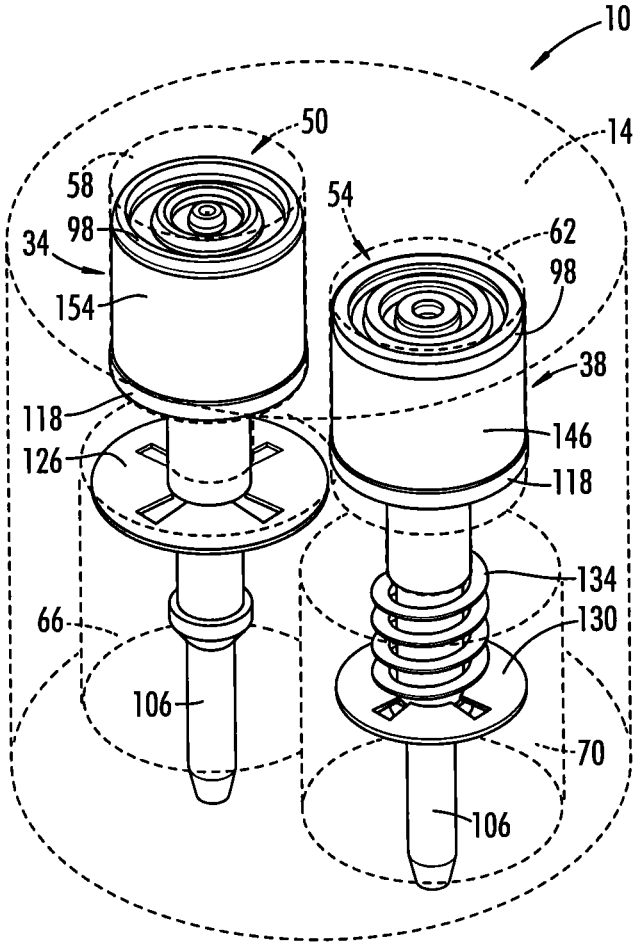
FIG. 2 is a top, side-by-side, perspective view of the two terminals in normal position in an electrical connector shown in phantom lines so details of the two terminals can be seen, according to an aspect of the disclosure.
Figure 3A:
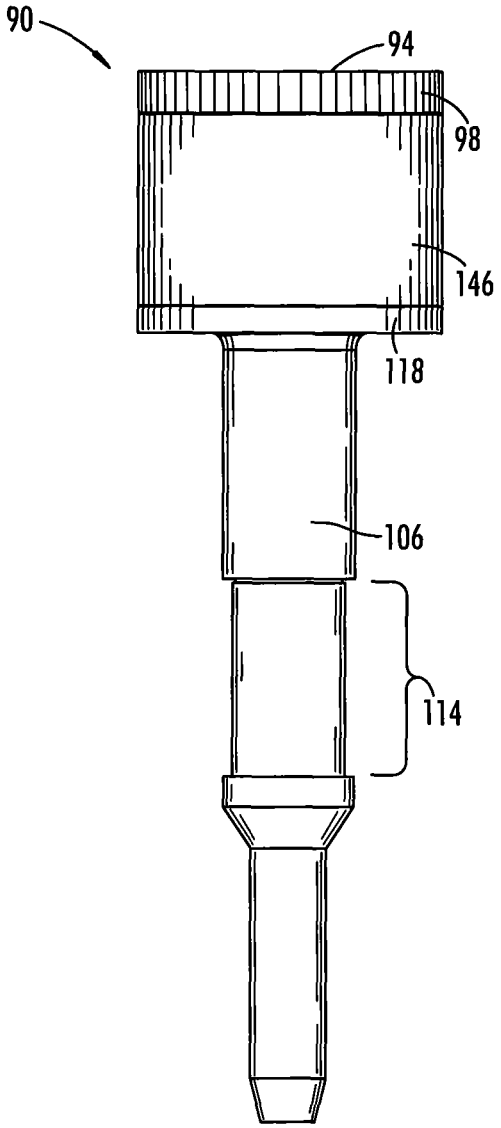
FIGS. 3A and 3B show side view of a terminal in an exterior view and a cross-sectional view, respectively, according to an aspect of the disclosure.
Figure 3B:
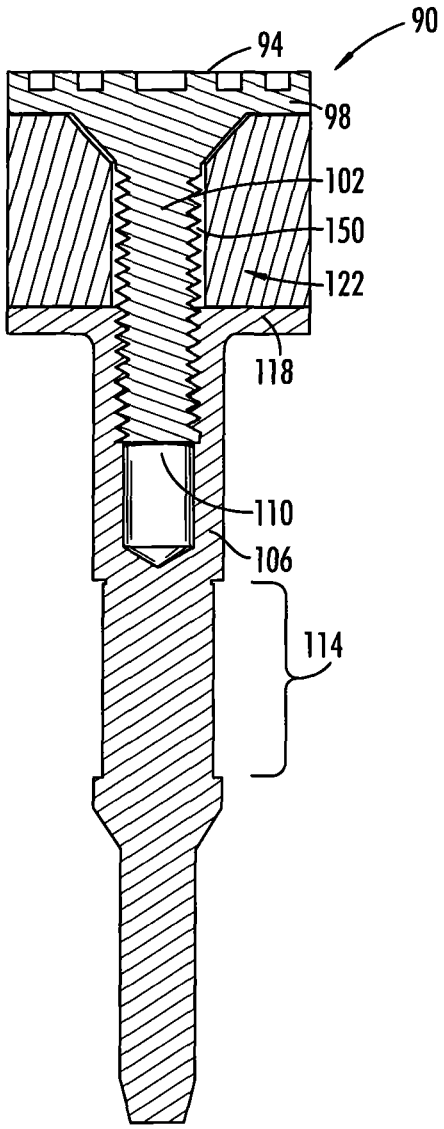

FIG. 2 shows connector 10 with housing 14 drawn in phantom lines so that fixed terminal 34 and movable terminal 38 can be viewed more easily. FIGS. 3A and 3B show contacts 42, 46 from the side and in cross section, respectively. Housing 14 has two passages formed therein, passage 50 and passage 54. Passages 50 and 54 are spaced apart and may be parallel. Both passage 50 and 54 have an upper chamber 58, 62, and a lower chamber 66, 70, respectively that are defined by a wall 74, 78, respectively, that separates them. There is a hole 82, 86, formed in wall 74, 78, to allow upper chambers 58, 62, to communicate with lower chambers 66, 70 Fixed terminal 34 is in first passage 50; movable terminal 38 is in second passage 54. Every terminal 34 is identical to every other terminal 34, and every terminal 38 is identical to every other terminal 38. Terminals 34 and 38 are very similar to each other except for a few differences, which will be described presently. Passage 50 and 54 may also be dimensionally the same.

FIGS. 3A and 3B show exterior and cross-sectional view of a terminal 90 identical to terminals 34, 38. Terminal 90 has a contact 94 with an expanded top 98 and an upper shaft 102. Upper shaft 102 has external threads and, where it meets expanded top 98, its outer diameter may flare slight.

Terminal 90 has a lower shaft 106 with a hole 110 formed therein that has interior threads and is dimensioned to receive upper shaft 102. Lower shaft 106 has a cylindrical groove 114, that is, a portion of its length that has a reduced diameter and beyond which on lower shaft in both directions away from groove 114, the diameter of lower shaft 106 is larger. Terminal 90 also has a top flange 118 that, between expanded top 98 and top flange 118, define an annular recess 122. For convenience, reference numbers applied to terminal 90 will be used on the equivalent structures on terminal 34, 38.

A first spring washer 126 is attached to lower shaft 106 or first terminal 34 just above groove 114 and against wall 74 so that expanded top 98 of fixed terminal 34 is held fixed below top surface 26 of housing 14. First spring washer 126 is selected and dimensioned to hold tightly to lower shaft 106 where it is placed because at that location, diameter of lower shaft 106 is slightly larger than the diameter of groove 114. Terminal 34 is restrained from upward movement with respect to passage 50 because of the position of first spring washer 126, which is on one side of wall 74, and top flange 118 is on the other side preventing downward movement of fixed terminal 34 with respect to first passage 50.

In second passage 54, downward movement of terminal 38 is restricted because of top flange 118 but upward movement is not restricted, although it is limited. A second spring washer 130 is mounted to lower shaft 106 at the lower end of groove 114 to prevent vertical movement of terminal 38 that would otherwise enable removal of movable terminal 38 from second passage 54. A compression spring 134 encircles lower shaft 106 above second spring washer 130 and resists vertical movement of movable terminal 38. As movable terminal 38 moves upward, compression spring 134 is loaded and urges movable terminal to recede into second passage 54. When compression spring 134 is fully compressed, second spring washer 130 and compression spring 134 prevent further movement of movable terminal. At that point, expanded top 98 of movable terminal 38 extends above top surface 26 by the same distance that fixed terminal is recessed inside fixed terminal 34.

In FIG. 2, both fixed terminal 34 and movable terminal 38 are shown in their "at rest" positions.

Figure 4:
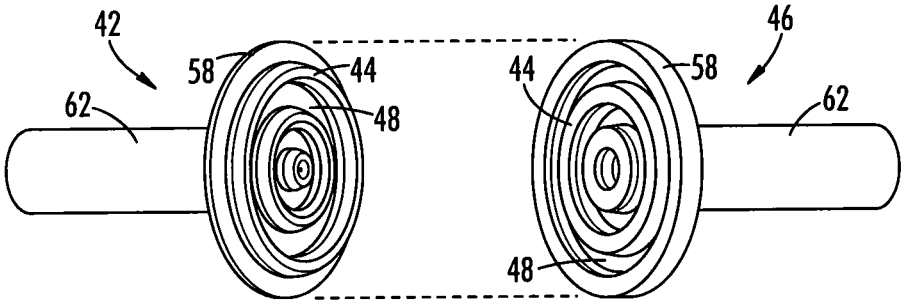
FIG. 4 is a top perspective view of two contacts showing their complementary top surfaces, according to an aspect of the disclosure.
Figure 5A:
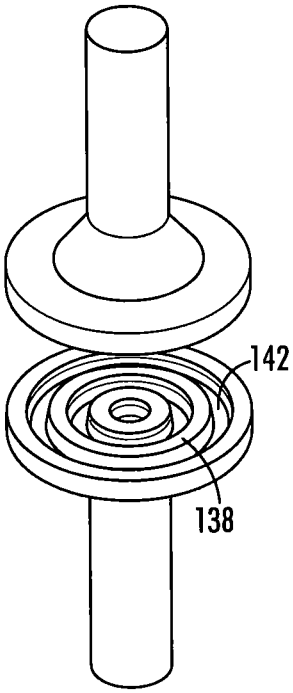
FIGS. 5A and 5B are top perspective and side cross-sectional views, respectively, of the spaced-apart contacts of FIG. 4, according to an aspect of the present disclosure.
Figure 5B:
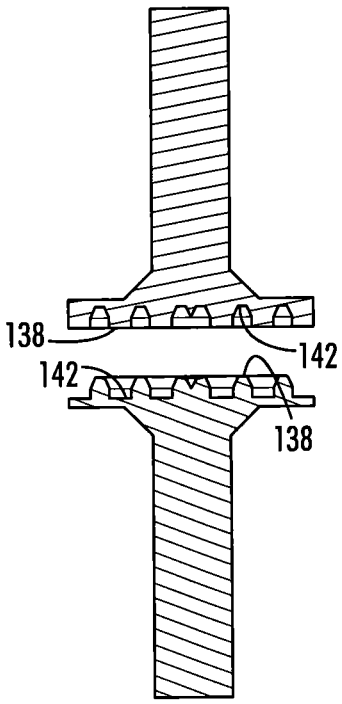

FIG. 4 shows first and second contacts 42 and 46 side by side. Each contact 42, 46, has an expanded top 98 and an upper shaft 102. Expanded tops 98 of first and second contacts 42 and 46 are configured with concentric rings 44 separated by concentric grooves 48. See also FIG. 1. FIGS. 5A and 5B show first and second contacts 42, 46, with expanded tops 98 facing each other in perspective and cross-sectional views, respectively. In FIGS. 5A and 5B, concentric rings 138 and concentric grooves 142 of first and second contacts 42, 46, are beveled so that they interleave more easily than concentric rings 44 and concentric grooves 48 of FIGS. 1 and 4 when first and second contacts 42, 46 are brought together. Concentric rings 138 enter concentric grooves 142 of second contact 46, and concentric grooves 142 of first contact 42 receive concentric rings 138 of second contact 46. Although concentric rings 138 and concentric grooves 142 are shown, other examples of surface features that interleave are possible, such as spaced rows of parallel ridges or a saw-toothed pattern or cylindrical pins on first contact 42 and holes in second contact 46. Expanded tops 98 of first and second contacts 42, 46, may be different or may be identical, but they interleave. When expanded tops 98 of first and second contacts 42, 46 interleave, there is more surface area in contact for the electrical current to pass from one to the other. Moreover, expanded tops 98 are less subject to coming apart in the event they are subjected to horizontal forces.

The particular configuration chosen is complementary whether identical or not identical. In this context, complementary FIG. 4 shows non-identical concentric rings 138 and concentric grooves 142. Other shapes of first and second contacts 42, 46 may be identical, but nevertheless first and second contacts 42, 46 interleave. Complementary means that expanded top 98 of first contact 42 is the negative of expanded contact 98 of second contact 46. Where expanded top 98 of first contact 42 has mass, expanded top 98 of second contact 46 has a recess shaped to accommodate that mass; and where expanded top 98 of first contact 42 has a recess, expanded top 98 of second contact 46 has mass shaped to fill that recess.

Fixed terminal 34 and movable terminal 38 differ in another respect that that one is fixed and the other is movable. Annular recess 122, seen best in FIG. 3B, of movable terminal contains a magnet 146. Magnet 146 has a torus shape and surrounds upper shaft 102 between expanded top 98 and top flange 118. Magnet 146 may be a rare earth magnet. A non-conductive spacer 150 may be placed between magnet 146 and upper shaft 102.

In movable terminal 38, in annular recess 122 is a ferromagnet 154. Ferromagnet 154 is not a magnet but is a material that, while producing no magnetic field of its own, responds to the magnetic field of a magnet or electromagnet regardless of polarity.

Figure 6A:
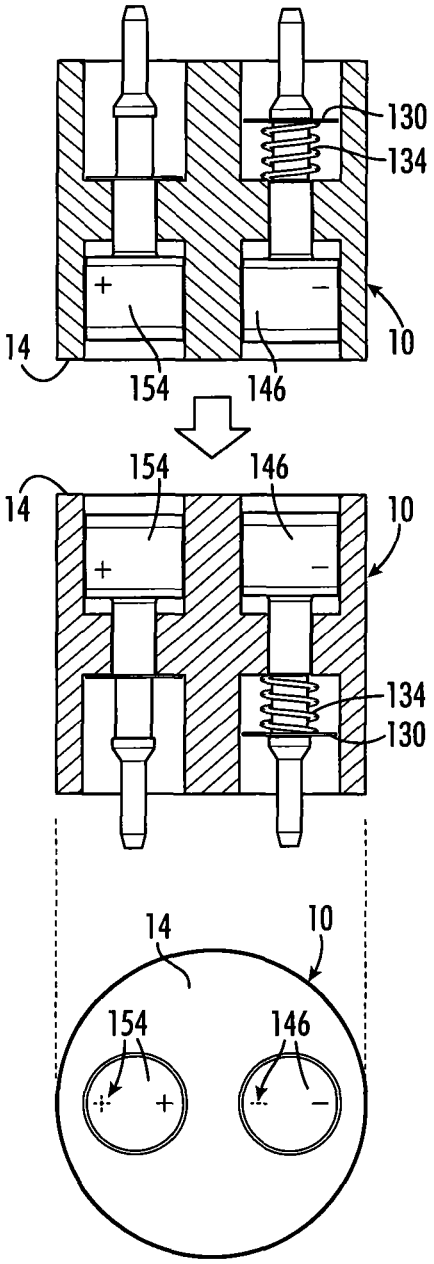
FIGS. 6A-6F show in cross section the movements of the terminals of two electrical connectors and one of the connectors itself in response to an attempt to connect them improperly, according to an aspect of the disclosure, with FIG. 4A showing poles facing each other but with the wrong polarity, FIG. 4B, showing connectors brought together with the wrong polarity, FIGS. 4C, 4D, and 4E showing connectors rotating in response to the magnetic field to self-organize the polarity, and finally with FIG. 4F showing connectors in the right polarity and aligned.
Figure 6B:
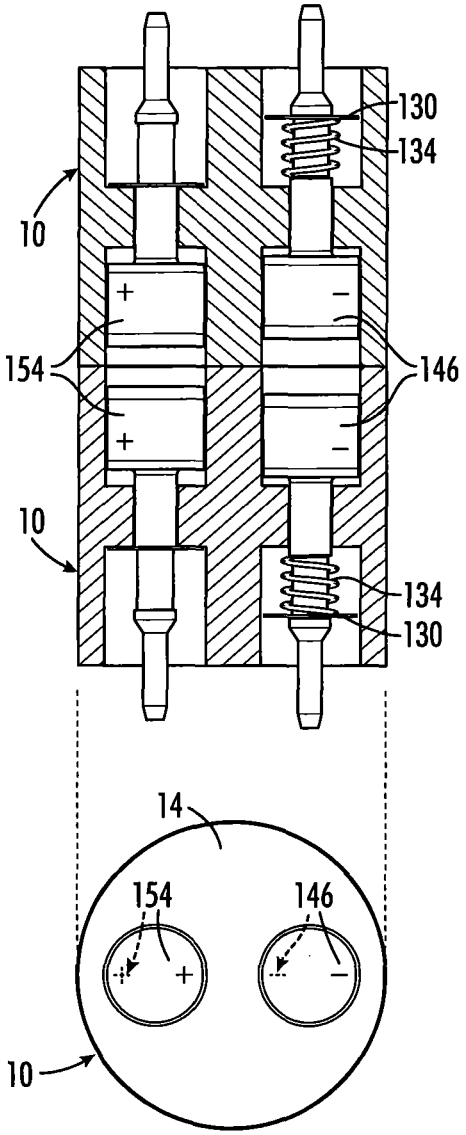

FIGS. 6A-6F show two opposing connectors 10, 10', being brought together. FIG. 6A shows connector 10 fixed in place while connector 10' is being lowered toward connector 10. In this example both fixed terminals 34 and 34' and movable terminals 38, 38' of electrical connectors 10, 10' are directly opposite each other. The magnets 146, 146' in movable terminals 38, 38' are all oriented the same way, so the poles of two electrical connectors 10, 10', when brought together face-to-face, repel each other. The mutual repulsive forces of magnets 146, 146' move terminals 38, 38' apart and thereby prevent contact, as seen in FIG. 6B. Ferromagnets 170, 170', in electrical connectors 10, 10', neither attract each other nor repel each other. Because they are not movable and they are recessed in upper chambers 58, 58' of passages 50, 50', they also are not in contact so no current passes through between contacts 42, 42' or 46, 46'.

Figure 6C:
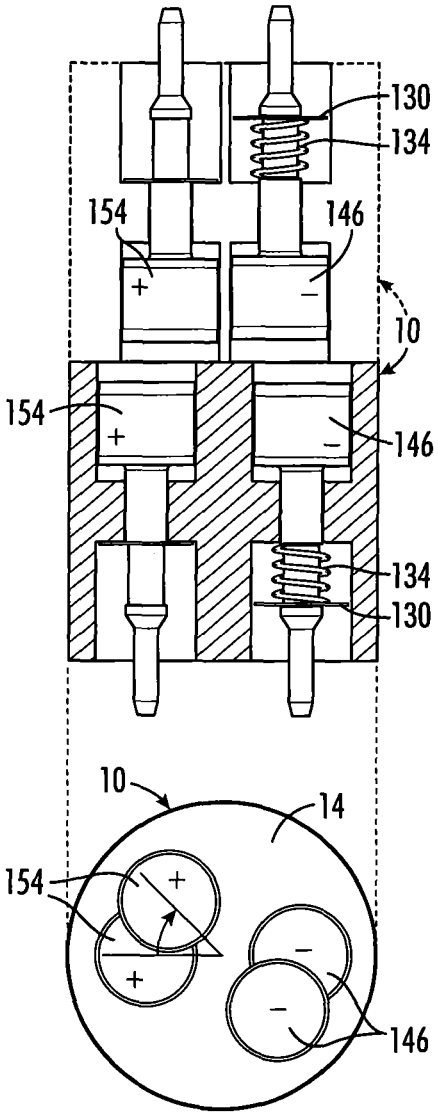

However, to the extent that the magnetic fields of the adjacent magnets 146, 146' influence ferromagnets 170, 170', and repel each other, connector 10' starts to twist and reorient itself, as seen in FIG. 6C.

Figure 6D:
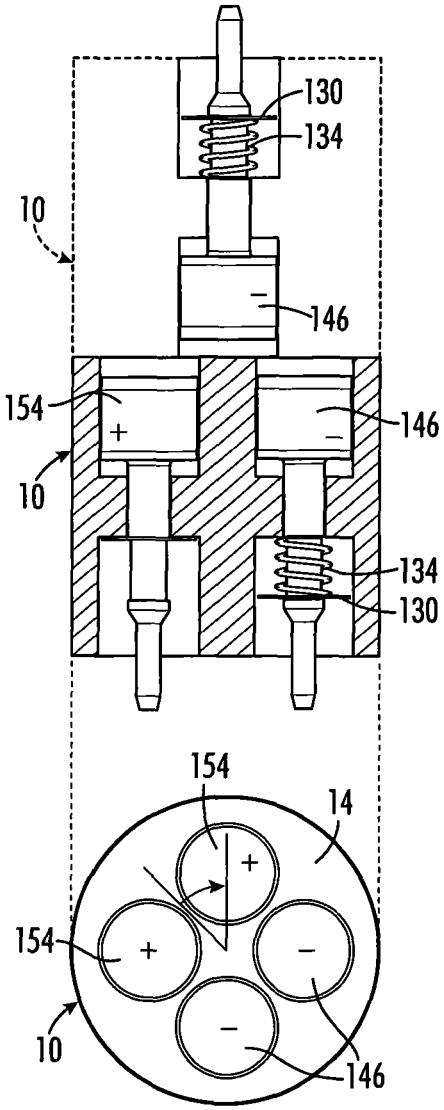
Figure 6E:
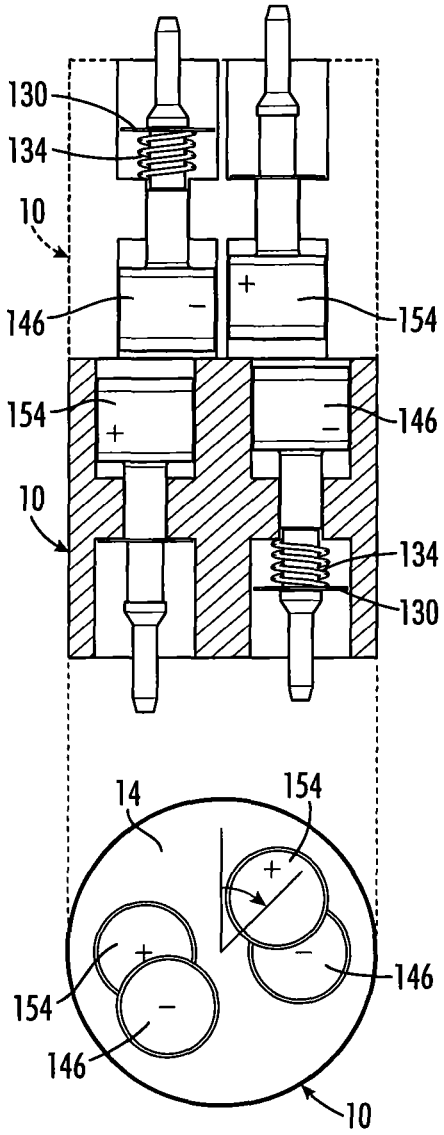
Figure 6F:
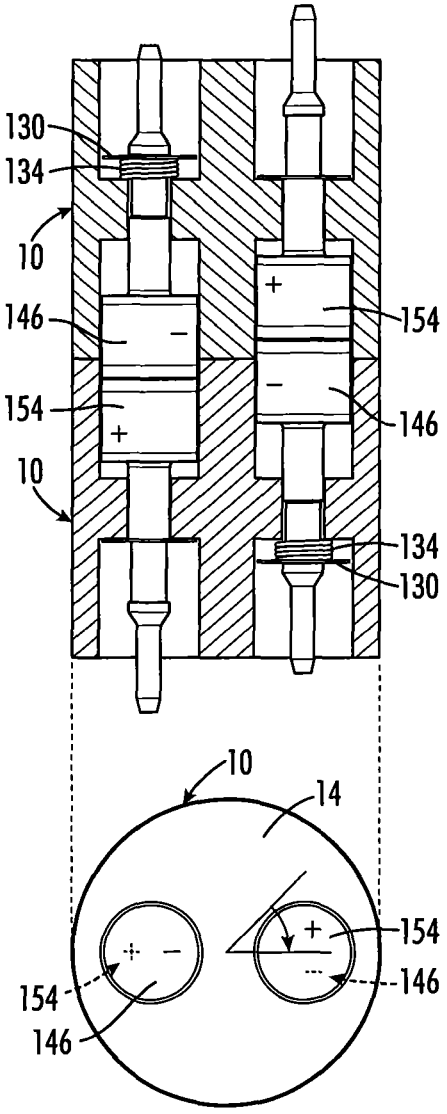

As this process of reorientation continues, best seen by comparing FIGS. 6D and 6E, connector 10' rotates so that fixed terminal 34' is moving to oppose movable terminal 38 and movable terminal 38' is simultaneously aligning with fixed terminal 34. Finally, in FIG. 6F, realignment is complete, and the magnetic fields of magnets 146, 146' of movable terminals 38, 38' are drawn partially out of their second passages 54, 54' and their respective contacts 46, 46' interleave with the contacts 42, 42' of opposing terminals 34, 34'. The combination of interleaving and the movement of movable terminals 38, 38' out of their second passages 54, 54' helps to maintain the connection despite lateral forces.

Figure 7:
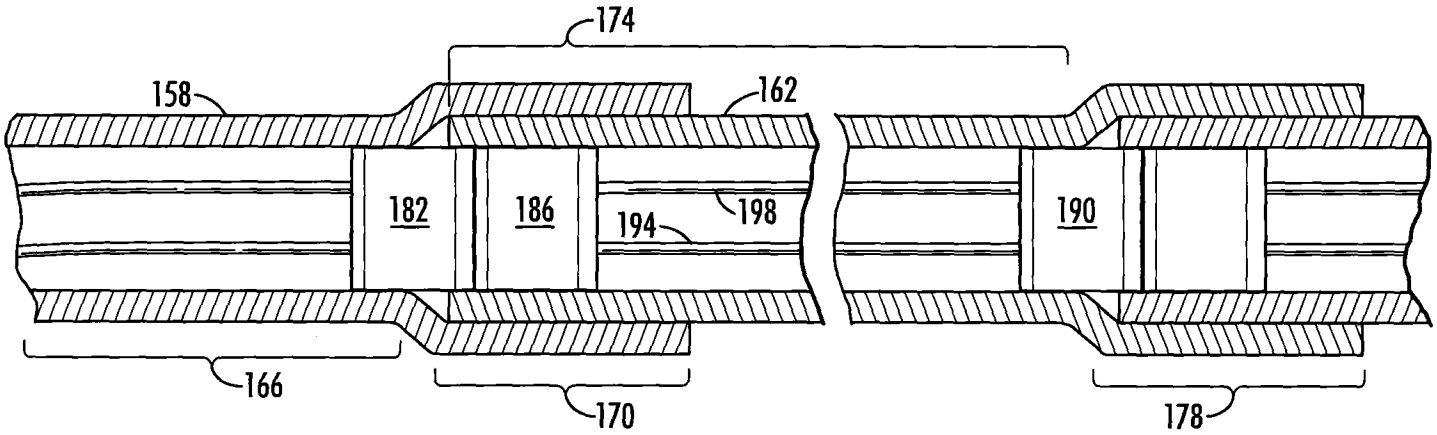
FIG. 7 illustrates electrical connectors in a conduit, according to an aspect of the disclosure.

Referring now to FIG. 7, there is shown two conduits, a first conduit 158 and a second conduit 162. First conduit 158 has a reduced diameter portion 166 and an expanded diameter portion 170. Likewise, second conduit 162 has a reduced diameter portion 174 and an expanded diameter portion 178. Inside first conduit 158 at its reduced diameter portion 166 is a first electrical connector 182 in electrical connection with a second electrical connector 186 that is flush mounted to the end of the reduced diameter portion of 174 of second conduit 162. Placing first electrical conductor 182 at the end of reduced diameter portion 166 inside first conduit 158 and placing second electrical conductor 186 flush with the end of reduced diameter portion 174 of second conduit 162 allows first and second electrical connectors 182-186 to be joined electrically when conduits 158 and 162 are joined physically.

Second electrical connector 186 and a third electrical connector 190 are connected in the same manner in second conduit 162 as if they were an extension cord: second electrical connector 186 is at one end and third electrical connector 190 is at the other end of a pair of wires 194, 198, which may be joined in parallel with insulation and connected to the ends of the terminals (34, 38, in FIG. 2) of second and third electrical connectors 186, 190. To preserve polarity, fixed terminal 34 of second electrical connector 186 would be joined to fixed terminal 34 of third electrical connector 190 and movable terminal 38 of second electrical connector 186 would be joined to movable terminal 38 of third electrical connector 190.

What is claimed is:

1. An electrical connector, comprising:

a housing having a top surface, a first passage, and a second passage spaced apart from said first passage, said first and second passages opening to said top surface;

a fixed terminal in said first passage, said fixed terminal having a first contact;

a movable terminal in said second passage, said movable terminal being movable with respect to said second passage, said movable terminal having a second contact;

a ferromagnet in said first passage proximate to said first contact; and a magnet in said second passage and carried by said movable terminal proximate to said second contact, said magnet forming a magnetic field in said second contact, said magnetic field of said magnet defining two magnetic poles oriented parallel to said second passage, wherein said magnet in said second passage moves said movable terminal with respect to said second passage in response to a mating electrical connector, wherein said first contact of said first terminal further comprises an upper shaft and a lower shaft having a hole therein dimensioned to receive said upper shaft of said first contact, and wherein said second contact of said movable terminal further comprises an upper shaft and a lower shaft having a hole therein dimensioned to receive said upper shaft of said second contact.

2. The electrical connector of claim 1, wherein movement of said movable terminal is restrained within said second passage so that said second contact rises above said top surface of said housing by a predetermined distance.

3. The electrical connector of claim 1, wherein said first contact surface is complementary to said second contact surface.

4. The electrical connector of claim 1, wherein said magnet is torus-shaped and surrounds said second contact.

5. The electrical connector of claim 1, wherein said magnet does not touch said second contact.

6. The electrical connector of claim 1, wherein said first and second passages are parallel.

7. The electrical connector of claim 1, wherein said electrical connector further comprises a compression spring in said second passage, said compression spring being above and in contact with said second spring washer, and wherein said compression spring resists movement of said magnet of said second terminal toward ferromagnetic material, when said ferromagnetic material is brought near said top surface of said housing.

8. The electrical connector of claim 1, wherein said fixed terminal is held in place by a spring washer.

9. The electrical connector of claim 1, wherein said fixed terminal and said movable terminal are identical.

10. An electrical connector, comprising:

a housing having a top surface, a first passage, and a second passage spaced apart from said first passage, said first and second passages opening to said top surface;

a fixed terminal in said first passage, said fixed terminal having a first contact with an expanded portion, an upper shaft, and a lower shaft with a hole formed therein to receive said upper shaft of said first contact;

a movable terminal in said second passage, said movable terminal having a second contact with an expanded portion, an upper shaft, and a lower shaft with a hole formed therein to receive said upper shaft of said second contact; and a magnet in said second passage and proximate to said second contact, said magnet having a magnetic field running through said second contact, said magnet moving said movable terminal in said second passage in response to the proximity of a mating electrical connector.

11. The electrical connector of claim 10, wherein said first passage has a wall therein dividing said first passage into an upper chamber and a lower chamber, said wall having a hole formed therein dimensioned to receive said lower shaft of said first contact and wherein said electrical connector further comprises a spring washer in said lower chamber of said first passage, and wherein said lower shaft of said first contact extends from said upper chamber through said hole in said wall into said lower chamber and through said spring washer, said spring washer of said fixed passage being attached to said lower shaft of said first contact and engaging said wall to hold said fixed terminal against movement of said first contact with respect to said housing.

12. The electrical connector of claim 10, wherein said second passage has a wall therein dividing said second passage into an upper chamber and a lower chamber, said wall having a hole formed therein dimensioned to receive said lower shaft of said second contact, and wherein said electrical connector further comprises a spring washer and a compression spring in said lower chamber of said second passage, and wherein said lower shaft of said second contact extends from said upper chamber through said hole in said wall into said lower chamber and through said compression spring and said spring washer of said movable terminal, said compression spring and said spring washer of said movable terminal cooperating with said wall to limit movement of said first contact above said top surface when said magnet is attracted to a ferromagnetic material.

13. The electrical connector of claim 10, further comprising a ferromagnet and wherein said first contact has an expanded top and an upper shaft and wherein said ferromagnet has a central hole dimensioned for receiving said upper shaft of said first contact.

14. The electrical connector of claim 10, wherein said second contact has an expanded top and an upper shaft and wherein said magnet has a central hole dimensioned for receiving said upper shaft of said second contact.

15. An electrical connector, comprising:

a housing having a top surface, a first passage, and a second passage spaced apart from said first passage, said first and second passages opening to said top surface;

a fixed terminal in said first passage, said fixed terminal having a first contact;

a movable terminal in said second passage, said movable terminal having a second contact; and a magnet in said second passage and surrounding said movable terminal, and proximate to said second contact, said magnet forming a magnetic field in said second contact, said magnetic field defining two magnetic poles oriented parallel to said second passage, wherein said magnet in said second passage moves said movable terminal in said second passage when said magnet is attracted to a mating electrical connector, and wherein said fixed terminal and said movable terminal are identical.

16. An electrical connector system, comprising:

(1) a first electrical connector having a first housing with
- (a) a top surface and a bottom surface,
- (b) a first passage and a second passage spaced apart from said first passage, said first and second passages opening to said top surface and to said bottom surface,
- (c) a fixed terminal in said first passage having a first contact with
  - (i) an expanded portion,
  - (ii) an upper shaft, and
  - (iii) a lower shaft with a hole formed therein to receive said upper shaft of said first contact in said hole in said lower shaft,
- (d) a movable terminal in said second passage, said movable terminal having a second contact with
  - (i) an expanded portion,
  - (ii) an upper shaft, and
  - (iii) a lower shaft with a hole formed therein to receive said upper shaft of said second contact in said hole in said lower shaft,
- (e) a magnet in said second passage and proximate to said second contact, said magnet having a magnetic field running through said second contact,
- (f) a ferromagnet in said first passage and proximate to said first contact;

(2) a second electrical connector having a first housing having
- (a) a top surface and a bottom surface,
- (b) a first passage and a second passage spaced apart from said first passage, said first and second passages opening to said top surface and to said bottom surface,
- (c) a fixed terminal in said first passage and having
  - (i) a first contact with an expanded portion,
  - (ii) an upper shaft, and
  - (iii) a lower shaft with a hole formed therein to receive said upper shaft of said first contact,
- (d) a movable terminal in said second passage, said movable terminal having
  - (i) a second contact with an expanded portion,
  - (ii) an upper shaft, and
  - (iii) a lower shaft with a hole formed therein to receive said upper shaft of said second contact,
- (e) a magnet in said second passage and proximate to said second contact, said magnet having a magnetic field running through said second contact,
- (f) a ferromagnet in said first passage and proximate to said first contact; and (3) a wiring harness including
- (a) a first wire of said pair of wires in electrical connection with said first contact of said first electrical connector and a first contact of said second electrical connector, and
- (b) a second wire of said pair of wires in electrical connection with said second contact of said first electrical connector and said second contact of said second electrical connector, wherein, when said first electrical connector is proximate to said second electrical connector, said magnetic field of said magnet of said first contact of said first electrical connector attracts said ferromagnet of said second contact of said second electrical connector, and said magnetic field of said magnet of said first contact of said second electrical connector attracts said ferromagnet of said second contact of first second electrical connector so that said first contact and said second contact of said first electrical connector and said second contact and said first contact of said second electrical connector, respectively, connect electrically.

17. The electrical connector system as recited in claim 16, wherein said first electrical connector further comprises a compression spring in said second passage, said compression spring being above and in contact with said second spring washer, and wherein said compression spring resists movement of said movable terminal; and wherein said second electrical connector further comprises a compression spring in said second passage, said compression spring being above and in contact with said second spring washer, and wherein said compression spring resists movement of said movable terminal.

18. The electrical connector system of claim 16, further comprising a conduit having a first end and a second end and wherein said first electrical connector is located near said first end of said conduit and said second electrical connector is near said second end of said conduit and said pair of wires runs inside said conduit from said first electrical connector to said second electrical connector.

19. The electrical connector system of claim 16, further comprising a conduit having a first end and a second end and wherein said first electrical connector is located flush with said first end of said conduit and said second electrical connector is recessed inside said second end of said conduit and said pair of wires runs inside said conduit from said first electrical connector to said second electrical connector.

* * * * *